US008397312B1

(12) United States Patent
Crye et al.

(10) Patent No.: US 8,397,312 B1
(45) Date of Patent: Mar. 19, 2013

(54) SUPPLEMENTAL BODY ARMOR COMPONENT

(75) Inventors: Caleb Clark Crye, Brooklyn, NY (US); Eric Owen Fehlberg, Queens, NY (US); Gregg M. Thompson, Brooklyn, NY (US)

(73) Assignee: Lineweight LLC, Brooklyn, NY (US)

( * ) Notice: Subject to any disclaimer, the term of this patent is extended or adjusted under 35 U.S.C. 154(b) by 1768 days.

(21) Appl. No.: 11/681,631

(22) Filed: Mar. 2, 2007

Related U.S. Application Data

(60) Provisional application No. 60/778,566, filed on Mar. 2, 2006.

(51) Int. Cl.
*A41D 13/00* (2006.01)

(52) U.S. Cl. ..... 2/2.5

(58) Field of Classification Search ..... 2/2.5, 94, 2/102, 455, 462–463, 467, 247–253
See application file for complete search history.

(56) References Cited

U.S. PATENT DOCUMENTS

| | | | | |
|---|---|---|---|---|
| 4,507,802 | A * | 4/1985 | Small | 2/2.5 |
| 5,996,115 | A * | 12/1999 | Mazelsky | 2/2.5 |
| 6,185,738 | B1 * | 2/2001 | Sidebottom | 2/2.5 |
| 7,080,411 | B2 * | 7/2006 | Kerr | 2/2.5 |
| 7,712,148 | B2 * | 5/2010 | Carlson | 2/2.5 |

* cited by examiner

*Primary Examiner* — Tejash Patel
(74) *Attorney, Agent, or Firm* — Stiennon & Stiennon

(57) ABSTRACT

A body armor component mounts to the waist of a wearer by attachment to a belt to protect the lower back of the wearer. The component has a flexible fabric carrier with a front sheet which faces the wearer, and two rear sheets sewn to the front sheet to define two pockets opening towards each other and joined by a connecting segment. A flexible soft ballistic armor element has a first wing connected by a center segment to a second wing, the ballistic armor element being concave and opening toward the wearer, and the first wing being received within the flexible carrier first pocket and the second wing being received within the carrier second pocket. A covering flap is pivotable on the fabric carrier to cover the gap between the pockets. A belt loop is defined by an accessory segment fixed to the covering flap.

10 Claims, 2 Drawing Sheets

SUPPLEMENTAL BODY ARMOR COMPONENT

CROSS REFERENCES TO RELATED APPLICATIONS

This applications claims benefit from U.S. provisional app. 60/778,566, filed Mar. 2, 2006, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to ballistic body armor in general, and to body armor for protecting the lower back in particular from projectile threats such as rifle and handgun bullets, and shrapnel.

Persons exposed to projectile threats, such as police officers and soldiers, may seek a certain level of protection by wearing armored clothing. Low velocity projectiles such as handgun rounds, fragmentation rounds from a grenade or mortar, and miscellaneous shrapnel may be countered by so-called "soft armor." Soft armor is worn in the form of jackets, vests, etc. which are composed of assemblies of ballistic fabric such as those formed from DuPont Kevlar® fibers or of Spectra® ultra high molecular weight polyethylene fibers from Honeywell. The soft armor is often fabricated as flexible panels which are received within pockets or pouches formed in fabric vests or jackets. In more serious threat situations, where higher velocity rifle rounds and fragments must be countered, soft armor has typically been supplemented with hard armor fabricated of rigid plates of ceramic, polymer, or metal.

Some conventional body armor vests have a gap or separation in the armor material on each side under the wearer's arms. These gaps allow for adjustment of the vest to fit different sized wearers. However, this gap can allow the front of the vest to be pulled down, for example by accessories or other loads attached to the front of the vest. This downward displacement of the vest front can result in the rear of the vest moving upwardly, thus exposing a large area of the wearer's lower back and sides.

What is needed is a component to protect this vulnerable area which does not excessively compromise the wearer's mobility.

SUMMARY OF THE INVENTION

The lower back and side protecting body armor component of the present invention mounts to the waist of a wearer by attachment to a waist encircling belt. The component has a flexible fabric carrier with a front sheet which faces the wearer, and two rear sheets sewn to the front sheet to define two pockets opening towards each other and joined by a connecting segment. A flexible soft ballistic armor element has a first wing connected by a center segment to a second wing, the ballistic armor element being concave and opening toward the wearer, and the first wing being received within the flexible carrier first pocket and the second wing being received within the carrier second pocket. A covering flap is pivotable on the fabric carrier to cover the gap between the pockets. A belt loop is defined by an accessory segment fixed to the covering flap, and other belt loops may be secured to the two rear sheets. A hard armor element may be received within a pocket formed on the interior of the covering flap.

It is an object of the present invention to provide a ballistic armor component for the protection of the lower back and sides of a wearer that has minimal interference with the wearer's mobility.

It is another object of the present invention to provide a lower back protective ballistic armor component that is economical to produce.

It is a further object of the present invention to provide a lower back protective ballistic armor component that may be readily modified to have protection against different levels of threat.

Further objects, features and advantages of the invention will be apparent from the following detailed description when taken in conjunction with the accompanying drawings.

DESCRIPTION OF THE PREFERRED EMBODIMENTS

Figure 1:
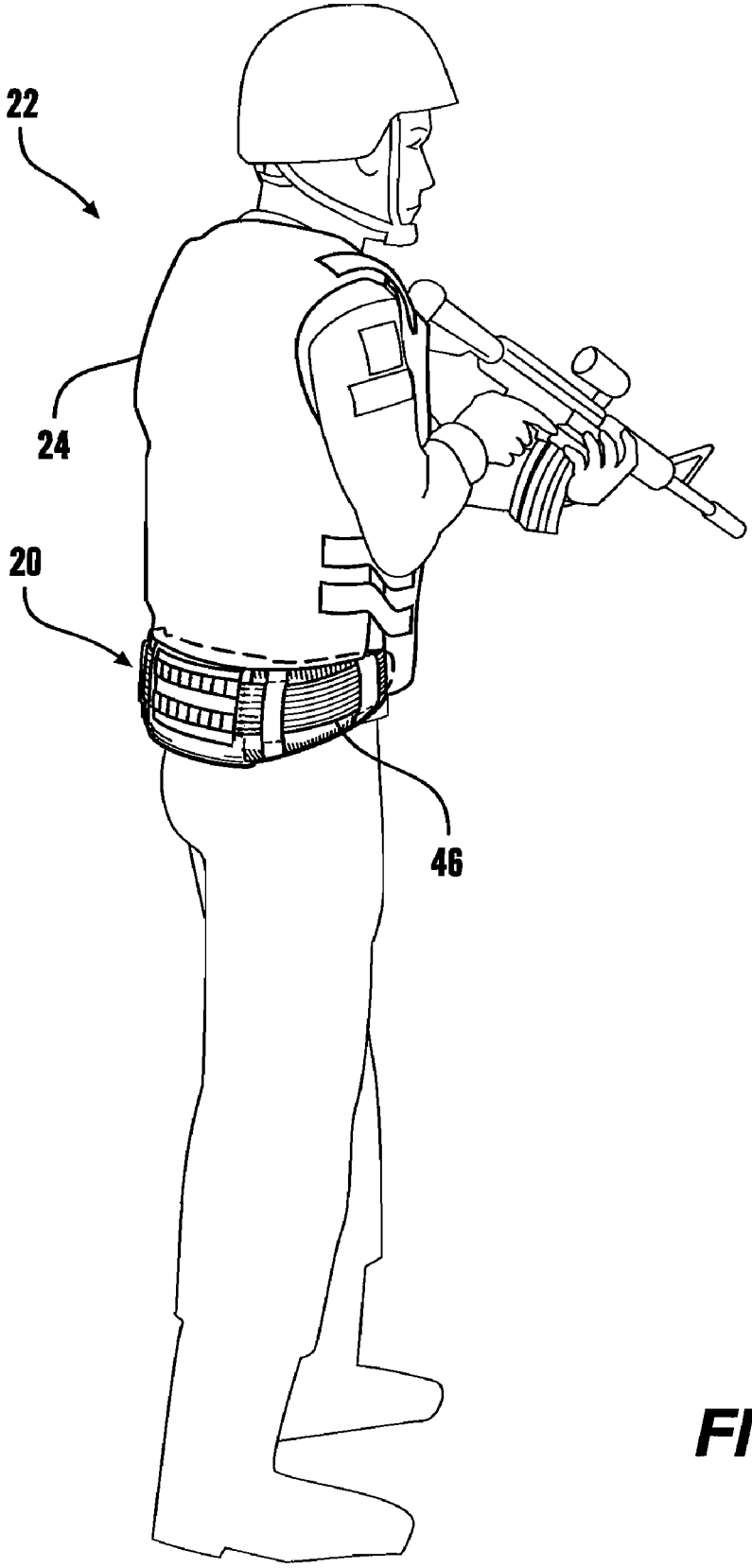
FIG. 1 is a rear perspective view of a serviceman wearing the lower back protecting body armor component of the present invention in conjunction with a conventional armor vest.

Referring more particularly to FIGS. 1-4, wherein like numbers refer to similar parts, a body armor component 20 for protection of the lower back of a wearer 22 is shown. As shown in FIG. 1, the component 20 will typically be worn together with some type of armored vest 24. The component 20 provides armored protection for the wearer's lower back, especially in a situation where the vest 24 may pull up in back and fail to provide protection.

Figure 2:
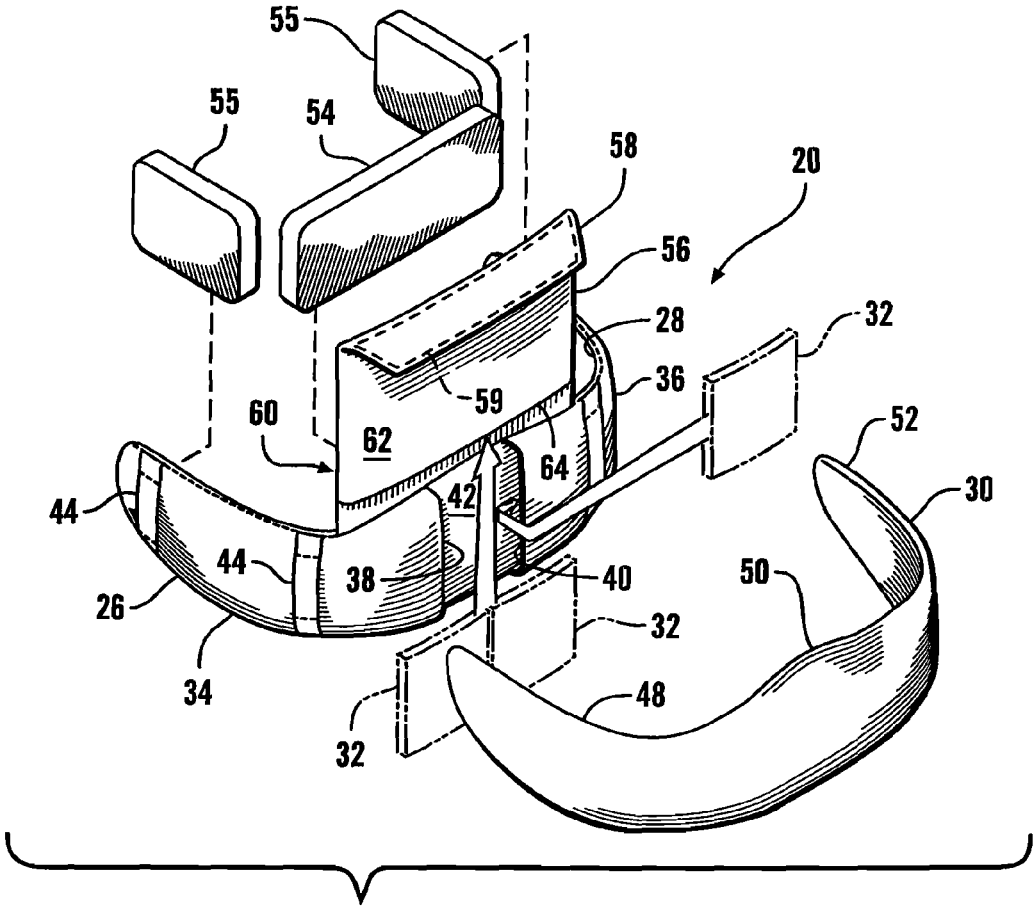
FIG. 2 is an exploded perspective view of the lower back protecting body armor component of FIG. 1 in an unassembled configuration.

As shown in FIG. 2, the body armor component 20 has a fabric armor carrier 26 which receives a soft armor ballistic element 30 and which may also be supplied with hard armor ballistic elements 32 if needed. By "ballistic element" is meant an element of soft or hard armor, configured to resist ballistic projectiles or fragments. The soft armor ballistic element 30 may be conventional soft armor, i.e., assemblies of ballistic fabric such as those formed from DuPont Kevlar® fibers, fibers of Spectra® ultra high molecular weight polyethylene fibers from Honeywell, or other ballistic material. The hard armor ballistic elements may be, for example, fabricated of rigid plates of ceramic, polymer, or metal.

The armor carrier 26 is narrower than it is long and wraps around the waist of the wearer 22 to provide protection in the rear and on the sides, and will usually not extend to the front of the wearer, where typically the armor vest will provide protection, although depending on user preference, the carrier may wrap around to the wearer's front side. Although the dimensions will vary depending on the size of the intended user, an example carrier is about 30 inches long and about six inches tall. The armor carrier 26 has a front sheet 28 which may be of a soft material with a loop like surface which permits it to act as the loop portion of a hook and loop fastener, such as VELCRO® fastener manufactured by Velcro Industries B.V. A first rear sheet 34 and a second rear sheet 36 are sewn to the front sheet 28 to define a first pocket 38 and a second pocket 40. The rear sheets may be a heavy duty nylon, pack-cloth, Invista's CORDURA® nylon material, or any suitable fabric or flexible material. The rear sheets may have a camouflage pattern applied thereto.

The pockets 38, 40 open towards each other, and are spaced from one another by a connecting segment 42 of the first sheet 28. The connecting segment may be about four inches wide. It should be noted that, in order to provide a finished sewn seam on the exterior of the armor carrier 26, the front sheet 28 and the rear sheets 34, 36 are sewn together in an inverted condition, and then turned inside out. The connecting segment 42 permits the armor carrier to be readily inverted.

Figure 3:
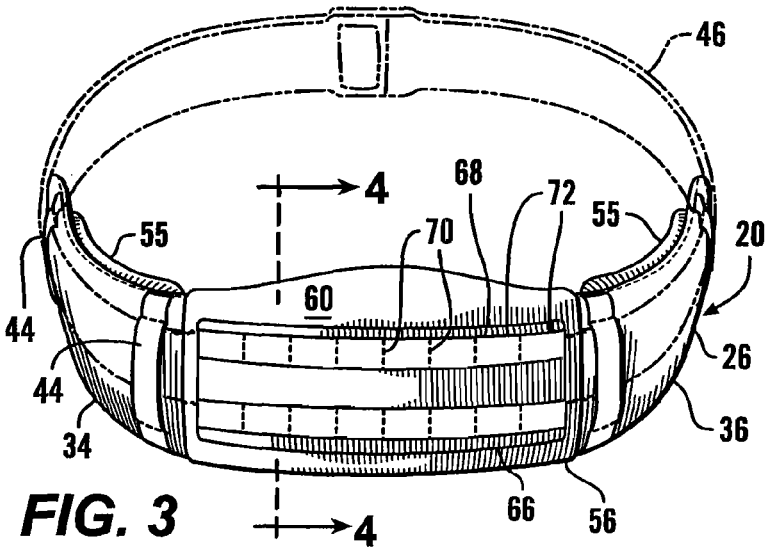
FIG. 3. Is a rear elevational view of the assembled body armor component of FIG. 3.
Figure 4:
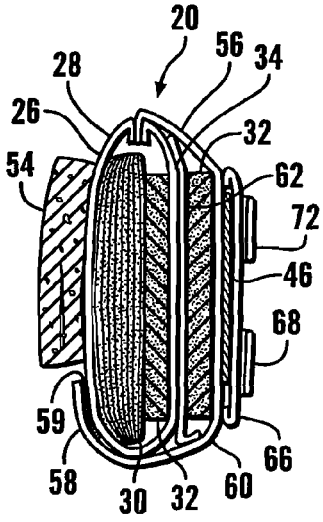
FIG. 4 is a cross-sectional view of the body armor component of FIG. 3, taken along section line 4-4, shown mounted to a belt.

Two belt loops 44 are sewn to each of the first rear sheet 34 and the second rear sheet 36, the loops being sized to receive a conventional belt 46 therethrough. As shown in FIGS. 1 and 3, it is the belt 46 which supports the component and holds it in position on the wearer 22. For added comfort, foam pads 54, 55 are adhered to the exterior surface of the front sheet 28 of the carrier 26. The back pad 54 is preferably formed separately and spaced from the side pads 55. The pads may be fabricated of a conventional closed cell compression molded foam, an open cell foam, spacer fabric or any appropriately resilient material. Although three pads are shown, a single pad may be used, or a greater number of smaller pads. The pads 54, 55 may be attached to the front sheet 28 in any conventional fashion. In a preferred embodiment the pads are backed with the hook material of a hook and loop fastener material like Velcro fastener, to allow the ready attachment and positioning of the pads. The fastening material is not shown in the drawings.

The soft armor ballistic element 30, best shown in FIG. 2, is a thin concave element, generally C-shaped, which is curved to wrap around the sides of the wearer. The soft ballistic armor element may be about one-half inch thick. The soft armor ballistic element 30 has a center segment 50 with a first wing 48 which is received within the first pocket 38 and a second wing 52 which is received within the second pocket 40. It should be noted that the soft ballistic element may be formed as a stack of multiple layers of ballistic material, for example material of Kevlar® fibers, or, for example, layers of Spectra® fiber material. The stack may be stitched around the periphery, in a quilted pattern, or otherwise, to form a stiffer ballistic element. Preferably additional stiffening shape is provided to the ballistic element by adding a stiffening plastic layer, not shown, to the layers of ballistic material. By adding stiffness to the soft armor ballistic element 30, the component 20 is better able to retain its shape and support loads attached to the component. The plastic layer may be about 1/16 to 1/32 inches thick polycarbonate such as General Electric's Lexan® polycarbonate resin thermoplastic material, and may be adhered or stitched to the ballistic element as disclosed in U.S. Pat. No. 6,892,392, the disclosure of which is incorporated by reference herein. The soft armor ballistic element 30 preferably has an enclosing sewn fabric bag to protect it from wear and soiling. This bag may be a lightweight nylon material.

A fabric covering flap 56 is sewn to the top edge of the front sheet 28 of the carrier 26. The flap 56 is tall enough to fully overlap the rear surface of the connecting segment and portions of the two pockets 38, 40 when it is folded down. The flap 56 is about three times as wide as the connecting segment 42.

A closure tab 58 extends from the covering flap 56 and has a patch 59 of a part of a hook and loop fastener attached thereto, in the illustrated example the hook part, to allow the closure tab to be folded upwardly and secured to the loop like material of the front sheet 28. The closure tab 58 thus engages with the carrier to retain the covering flap in a closed position. The covering flap 56 is preferably formed of an outside sheet 60 which is sewn to the front sheet 28 of the carrier, and an inside sheet 62 which is sewn to the outside sheet to define an armor pocket 64 therebetween. The armor pocket 64 faces downwardly when the flap is open, and upwardly when the flap is secured in its closed position. As shown in FIG. 2, the armor pocket 64 provides a position to optionally hold two hard armor ballistic elements 32.

The hard armor ballistic elements 32, may be formed having a slight curvature about a vertical axis to better conform to the wearer. The hard armor ballistic elements 32 are generally stiff, and may be about three-eighths of an inch thick and about 3½ inches on a side. Two or three hard armor ballistic elements 32 may be inserted within each of the first pocket 38 and the second pocket 40, the number may vary depending on the size of the component 20.

A support sheet 66 of fabric is sewn to the outside sheet 60 of the covering flap. The support sheet 66 is sewn only along its top margin and its bottom margin, to form a sleeve which is open to the sides and which serves as a long belt loop through which the belt 46 may extend. Two strips of webbing 68 are sewn with parallel vertical seams 70 to define an array of accessory loops 72 which can receive conventional accessory attachment belts and fasteners. The component 20 thus allows a user to carry additional items on the belt 46 while simultaneously providing ballistic protection.

Once the soft armor ballistic element 30 is installed within the carrier 26, and the hard armor plates 32 have been installed, if desired, the covering flap 56 is folded into a position which overlies the carrier connecting segment 42 and the soft armor ballistic element 30 installed within the pockets, as shown in FIG. 3. The hook and loop fastener then secures the flap 56 in a closed position.

It is understood that the invention is not limited to the particular construction and arrangement of parts herein illustrated and described, but embraces all such modified forms thereof as come within the scope of the following claims.

We claim:

1. A body armor component for mounting to the waist of a wearer by attachment to a belt, the component comprising:

a flexible carrier having portions defining a first pocket spaced from a second pocket by a connecting segment;

a flexible soft ballistic armor element having a first wing connected by a center segment to a second wing, the ballistic armor element being concave and opening toward the wearer, the first wing being received within the flexible carrier first pocket and the second wing being received within the carrier second pocket; and a covering flap mounted to the carrier and pivotable between a first position which reveals the carrier connecting segment to permit entry of the ballistic armor element into the first pocket and the second pocket, and a second position which overlies the connecting segment and the ballistic armor element installed within the pockets.

2. The body armor component of claim 1 further comprising:

an interior pocket formed on the covering flap; and at least one ballistic hard armor element received within the covering flap interior pocket.

3. The body armor component of claim 1 further comprising a closure tab extending from the covering flap, the closure tab having a first part of a hook and loop fastener thereon to engage with a second part of the hook and loop fastener which faces frontwardly from the carrier, the closure tab being engageable with the carrier to retain the covering flap in the second position.

4. A body armor component for mounting to the waist of a wearer by attachment to a belt, the component comprising:

a flexible carrier having portions defining a first pocket spaced from a second pocket by a connecting segment;

a flexible soft ballistic armor element having a first wing connected by a center segment to a second wing, the ballistic armor element being concave and opening toward the wearer the first wing being received within the flexible carrier first pocket and the second wing being received within the carrier second pocket, portions of the carrier which define at least one sidewardly opening belt loop to receive the belt therethrough; and a covering flap mounted to the carrier and pivotable between a first position which reveals the carrier connecting segment to permit entry of the ballistic armor element into the first pocket and the second pocket, and a second position which overlies the connecting segment and the ballistic armor element installed within the pockets, and wherein the at least one belt loop is defined by a support sheet fixed to the covering flap to overlie the covering flap in the second position to define a sleeve which allows the belt to pass between the covering flap and the accessory flap to be positioned rearwardly of the ballistic armor component.

5. A body armor component for mounting to the waist of a wearer by attachment to a belt to protect the lower back of the wearer, the component comprising:

a flexible carrier having a front sheet which faces the wearer, a first rear sheet sewn to the front sheet to define a first pocket with a first opening, and second rear sheet is sewn to the front sheet to define a second pocket having a second opening which faces the first pocket first opening, portions of the front sheet defining a connecting segment extending between the first pocket and the second pocket; and a flexible soft ballistic armor element having a first wing connected by a center segment to a second wing, the ballistic armor element being concave and opening toward the wearer, the first wing being received within the flexible carrier first pocket and the second wing being received within the carrier second pocket, portions of the carrier which define at least one sidewardly opening belt loop to receive the belt therethrough; and a covering flap mounted to the carrier and pivotable between a first position which reveals the carrier connecting segment to permit entry of the ballistic armor element into the first pocket and the second pocket, and a second position which overlies the connecting segment and the ballistic armor element installed within the pockets.

6. The body armor component of claim 5 further comprising:

an interior pocket formed on the covering flap; and at least one ballistic hard armor element received within the covering flap interior pocket.

7. The body armor component of claim 5 further comprising a closure tab extending from the covering flap, the closure tab having a first part of a hook and loop fastener thereon to engage with a second part of the hook and loop fastener which faces frontwardly from the carrier, the closure tab being engageable with the carrier to retain the covering flap in the second position.

8. The body armor component of claim 5 wherein the at least one belt loop is formed on a rearwardly facing surface of the carrier to overlie the first pocket, and further comprising at least one second belt loop formed on a rearwardly facing surface of the carrier to overlie the second pocket.

9. A body armor component for mounting to the waist of a wearer by attachment to a belt to protect the lower back of the wearer, the component comprising:

a flexible carrier having a front sheet which faces the wearer, a first rear sheet sewn to the front sheet to define a first pocket with a first opening, and second rear sheet is sewn to the front sheet to define a second pocket having a second opening which faces the first pocket first opening, portions of the front sheet defining a connecting segment extending between the first pocket and the second pocket; and a flexible soft ballistic armor element having a first wing connected by a center segment to a second wing, the ballistic armor element being concave and opening toward the wearer, the first wing being received within the flexible carrier first pocket and the second wing being received within the carrier second pocket;

portions of the carrier which define at least one sidewardly opening belt loop to receive the belt therethrough;

a covering flap mounted to the carrier and pivotable between a first position which reveals the carrier connecting segment to permit entry of the ballistic armor element into the first pocket and the second pocket, and a second position which overlies the connecting segment and the ballistic armor element installed within the pockets, and wherein the at least one belt loop is defined by a support sheet fixed to the covering flap to overlie the covering flap in the second position to define a sleeve which allows the belt to pass between the covering flap and the accessory flap to be positioned rearwardly of the ballistic armor component.

10. The body armor component of claim of claim 9 further comprising a plurality of hard armor elements, at least one received within each of the first pocket and the second pocket.

* * * * *